US005138768A

United States Patent [19]

Collins

[11] Patent Number: 5,138,768

[45] Date of Patent: Aug. 18, 1992

[54] LOCK FOR KNIFE/SHEATH COMBINATION

[75] Inventor: Walter W. Collins, North Clover, S.C.

[73] Assignee: Wenoka Seastyle, West Palm Beach, Fla.

[21] Appl. No.: 654,486

[22] Filed: Feb. 13, 1991

Related U.S. Application Data

[63] Continuation-in-part of Ser. No. 561,285, Aug. 1, 1990, Pat. No. 5,067,239, which is a continuation of Ser. No. 345,695, May 1, 1989.

[51] Int. Cl.[5] ..... B26B 3/06

[52] U.S. Cl. ..... 30/151; 30/164; 30/162

[58] Field of Search ..... 30/151, 155, 329, 337, 30/340, 162, 164

[56] References Cited

U.S. PATENT DOCUMENTS 2,901,823 9/1959 Widen ..... 30/151 X
4,404,747 9/1983 Collins ..... 30/151
5,067,239 11/1991 Collins ..... 30/151

*Primary Examiner*—Timothy V. Eley
*Assistant Examiner*—Willmon Fridie, Jr.
*Attorney, Agent, or Firm*—Wolf, Greenfield & Sacks

[57] ABSTRACT

A knife and sheath combination having an interlock formed of a tab to carry an inwardly extending dog that is mounted on a laterally flexible stem to the sheath. The dog may be moved laterally to and from an interfering engagement with a stop carried on the handle of the knife.

13 Claims, 3 Drawing Sheets

LOCK FOR KNIFE/SHEATH COMBINATION

RELATED APPLICATIONS

This application is a continuation in part of U.S. patent application Ser. No 07/561,285 filed Aug. 1, 1990, now U.S. Pat. No. 5,067,239 which is in turn a continuation of application Ser. No. 07/345,695 filed May 1, 1989 now abandoned.

FIELD OF THE INVENTION

The present invention relates to a knife and sheath combination.

BACKGROUND OF THE INVENTION

A variety of mechanical devices have been developed for inter-engaging a knife and sheath while still permitting a quick release. Such interlocking features are important for the sporting uses and are particularly important for underwater divers who must be able to insert and remove a knife from a sheath quickly and efficiently while assured the knife will not slip from the sheath.

A variety of devices have been developed including one in which the blade is simply engaged in the sheath pocket by frictional engagement. That arrangement, is not satisfactory for underwater use because the blade may readily lose its frictional engagement with the sheath and slide out while the swimmer is moving through the water.

Another form of knife and sheath combines a strap that engages the knife handle and is secured by a snap fastener or the like. That configuration is not satisfactory for underwater use because the snap is not always properly fastened securely and because the user frequently will not be able to see or readily feel the snap underwater, especially when wearing gloves.

Other combinations include pushbuttons which are spring loaded to snap into engagement. Such knife and sheath combinations are exemplified by co-pending application Ser. No. 115,059, filed Oct. 10, 1987 and references cited during the prosecution of that application including, Widen, U.S. Pat. No. 2,901,823, issued Sep. 1, 1959, Collins, U.S. Pat. No. 4,404,747, issued Sep. 20, 1983 and Housinger U.S. Pat. No. 2,391,574, issued Dec. 25, 1945. Each of these issued patents and the co-pending application provide interlocks in which springloaded detents inter-engage a sheath or similar holder. While such arrangements may adequately provide an interlock with a rapid release mechanism, the constructions either involve an assembly of components during manufacturing or involve the use of moving parts when in use. For example, in the Widen U.S. Pat. No. 2,901,823, there is provided a spring detent which is secured to a sheath by riveting assembly, which in combination with a sliding bolt in the handle, provides a mechanism for release. The Collins U.S. Pat. No. 4,404,747, has a springloaded button assembled into the handle with this button adapted to project into a hole in the scabbard. The unit requires the manufacture of a number of different components and assembly. The Housinger U.S. Pat. No. 2,391,574, also involves an assembly of a springloaded detent which is riveted to a scabbard.

SUMMARY OF THE INVENTION

It is an object of the present invention to provide a knife and sheath combination that is simple and inexpensive to make, but which, nonetheless, securely holds the knife in the sheath when it is supposed to be secured, while providing quick release at an appropriate time.

A further object of the present invention is to provide a knife and sheath combination in which the knife can be inserted in either direction into the scabbard, and which can be used by either a right or left handed person with the blade facing forwardly and rearwardly.

A further object of the present invention is to provide an improved knife and sheath combination which is particularly adapted to underwater uses and in which the knife may be released readily from the sheath on positive lateral movement of a mechanism by the individual wearing the sheath.

A still further object of the present invention is to provided an improved one piece sheath which may be injected molded and formed in a single operation, in combination with a knife having the locking mechanism integrally molded into the handle.

A still further object of the present invention is to provide a means for automatically locking a knife in a sheath as the knife is inserted into the sheath with the knife being securely locked.

One further object of the present invention is to provide an improved interlock for a knife and sheath in which the interlock is partially formed of an integrally molded component on the sheath and an integrally formed component on the handle of the knife.

A still further object of the present invention is to provide an improved interlock for a handle and sheath in which the interlock is solely formed with integrally formed components on the knife handle and sheath.

A still further object of the present invention is to provide an improved sheath construction for use with knives or tools having a handle. Such other tools may include prybars, screwdrivers, small saws and the like.

Another object of this invention is to provide a knife and sheath combination which is relatively inexpensive to make and which does not require assembly of locking mechanisms during the manufacturing process and which, because of its simplicity is not likely to require repair or maintenance during use.

In the present invention, there is provided a tool and sheath combination having a releasable interlocking mechanism. The interlocking mechanism is incorporated in part on the handle of the knife or tool and in part is integrally formed on the outer facing wall of the knife sheath. The interlock consists of an integrally molded, resilient component projecting upwardly from the upper edge of the outer facing wall of the sheath, and carrying an inwardly projecting dog. The resilient component is adapted to be deflected laterally for selective disengagement from a normal engaging position of the dog with a complementary recess molded into the handle of the knife or tool.

DESCRIPTION OF THE DRAWINGS

The foregoing objects and advantages of the present invention will be more clearly understood in connection with the accompanying drawings.

DETAILED DESCRIPTION OF THE INVENTION

Figure 1:
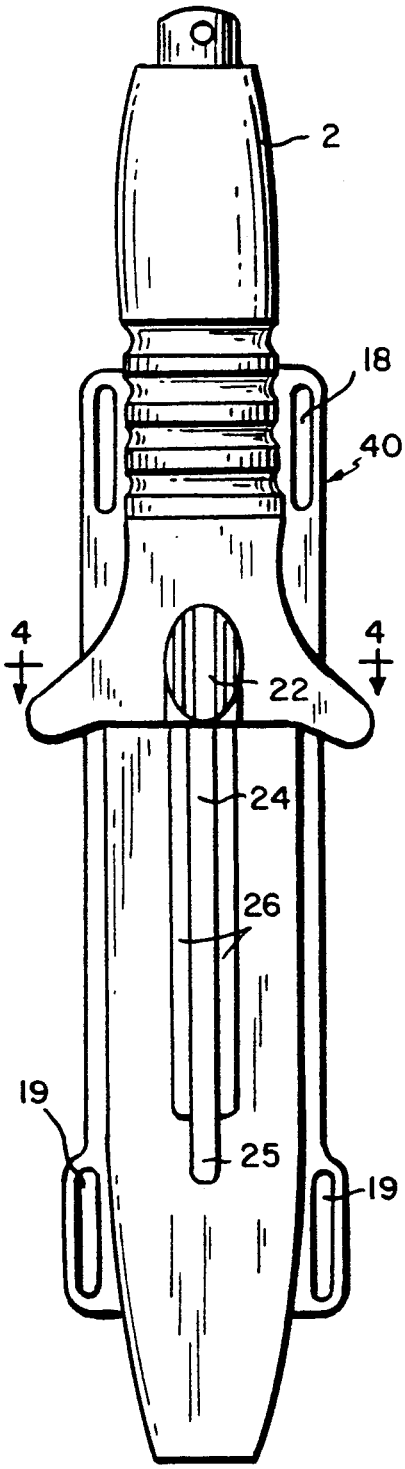
FIG. 1 is a plan elevation of the combination comprising a knife and a sheath embodying this invention.

In the preferred embodiment of this invention, a knife 1 having a handle 2 and a blade 3 is shaped to be secured with the blade within sheath 40. The knife handle 2 may be molded of any suitable plastic material about the upper end of the blade in a conventional fashion. The knife handle however, should be made of a material which is rigid and non yielding. The knife handle may take any desired shape. In the preferred embodiment illustrated, the knife is designed as a divers knife and consequently has a projecting hilt 4.

The blade 3, may be a double or single edge blade. In the embodiment illustrated, the blade has a principle cutting edge 5 on one side and a secondary cutting edge in the form of a saw section 6 on the other side. Other features, conventional with divers knives, may also be provided.

Figure 2:
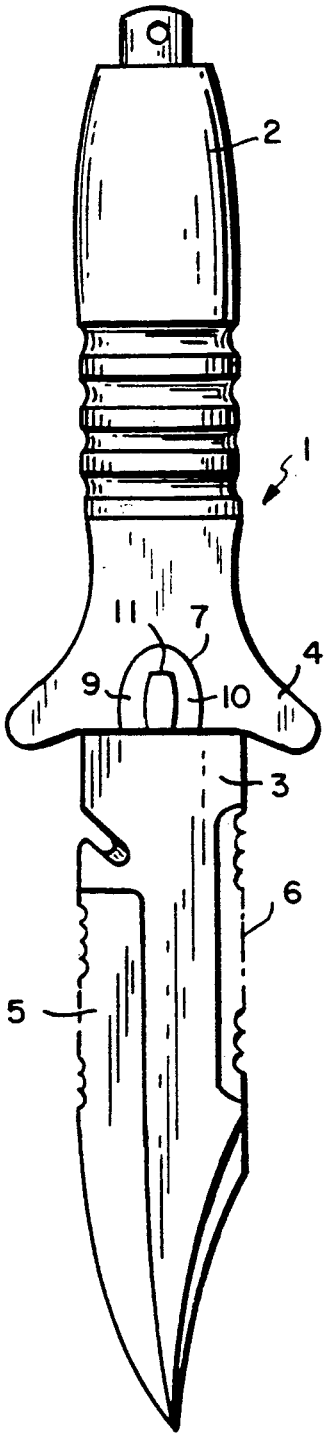
FIG. 2 is a plan elevation of the knife component.

The handle 2 is formed with means for cooperating with a complimentary component on the sheath to lock the knife in the sheath when it is fully inserted. Such means includes a recess 7 extending from the edge of the handle adjacent to the blade along its facing surface a length in the order of one half to three quarters of an inch. This recess which may be in the order of an eighth to a quarter of an inch deep, has a dog 8 projecting outwardly from its lower surface. This arrangement of the recess 7 and dog 8 define a pair of channels 9 and 10 on either side of the dog 8. The upper end of the dog is preferably flattened as illustrated at 11. A similar arrangement of a recess, dog, channels, and flattened end is also formed on the opposite side of the knife handle shown in FIG. 2.

The sheath 40 is preferably, integrally formed of a plastic material which preferably is non-reactive in sea water but does have sufficient flexibility to permit movement of the locking mechanism as hereinafter described. The sheath is formed with facing outer and inner walls 12 and 13 respectively that are integrally connected by sidewalls 14. The rear wall 13, is formed with an extension 15 that projects beyond the upper edges 16 of the front wall 12 and sidewalls 14. The extension 15 is provided with belt loops 18, while belt loops 19 are formed at the lower end of the wall 13. These loops 18 and 19 may be used to secure the scabbard to a belt or straps about the user's leg or waist. Also formed on the inner surface of wall 13 are a pair of rails 20. These rails each have a width slightly less than the width of channels 9 and 10 are located on the inner surface of the wall 13 to engage the handle 2 in channels 9 and 10 when the knife is fully inserted. The height of rails 20 should be slightly less than the depth of channels 9 and 10. The length of the rails 20 is not critical, provided, however, the upper end of rails 20 should not project above the end 11 when the knife is fully inserted in the sheath.

Figure 4:
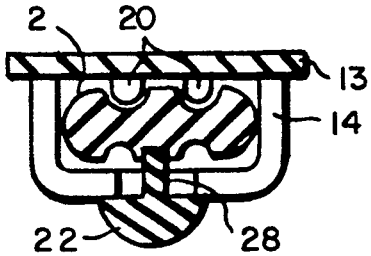
FIG. 4 is a cross sectional view taken substantially along the line 4—4 of FIG. 1.
Figure 3:
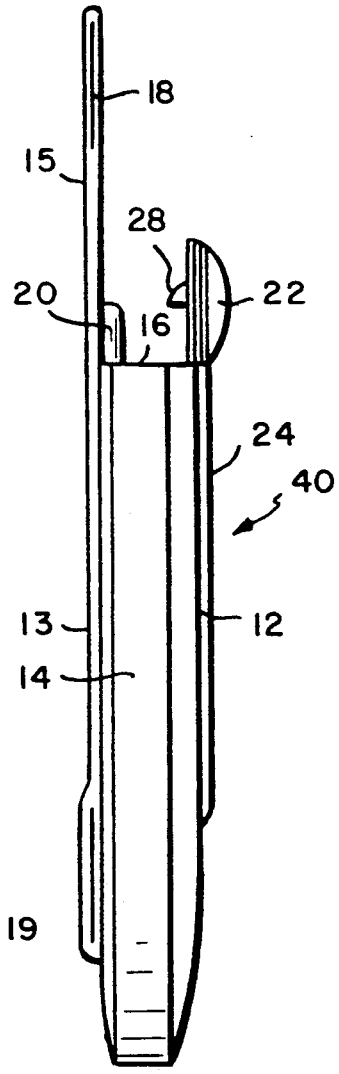
FIG. 3 is a sideview, looking from the left of the sheath with the knife removed.
Figure 5:
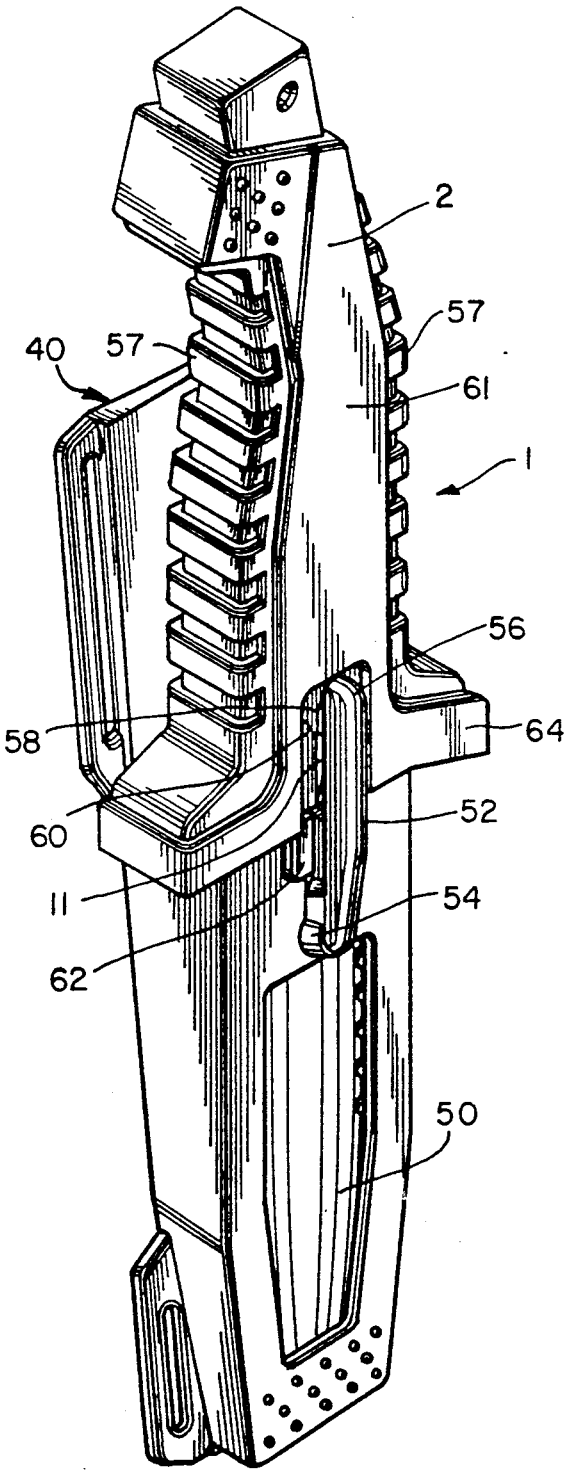
FIG. 5 is a perspective view of the knife and sheath combination of a second embodiment of the present invention.
Figure 6:
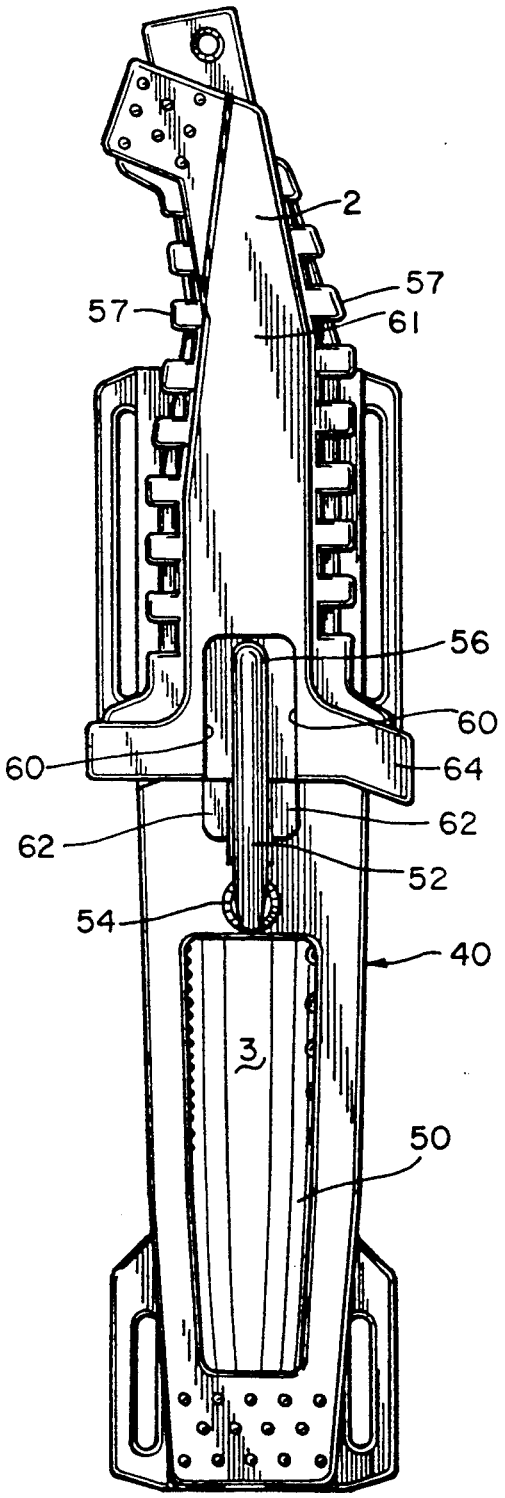
FIG. 6 is a planar view of the knife and sheath combination of the second embodiment of the present invention.
Figure 7:
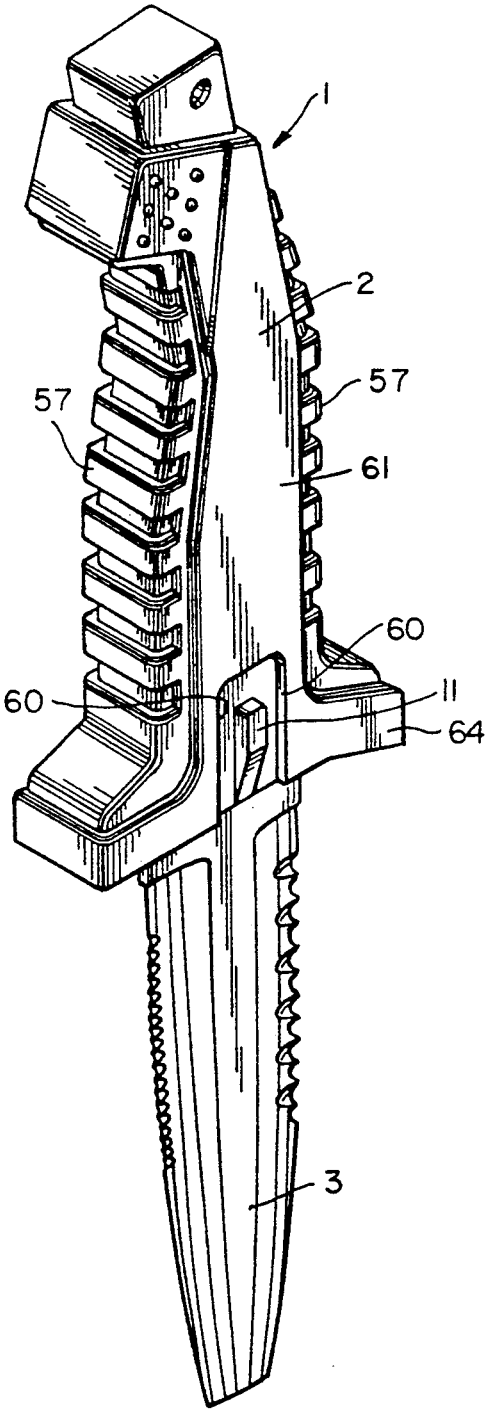
FIG. 7 is a perspective view of the knife of the second embodiment of the present invention.
Figure 8:
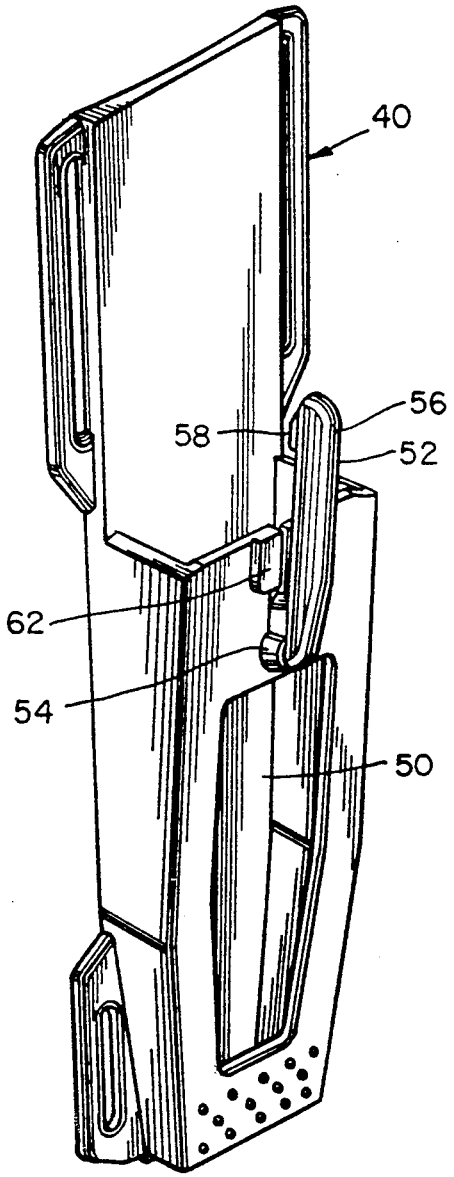
FIG. 8 is a perspective view of the sheath with the knife withdrawn of the second embodiment of the present invention.

A tab 22 preferably dome shaped as illustrated in FIG. 3, is integrally formed on a stem 24 that extends upwardly from its lower end 25 where it is integrally formed with the wall 12. Spaces or slots 26 on either side of stem 24 permit pendulum like movement of the tab 22 at the end of the stem 24. The edges 26 of the channels 9 and 10 limit the lateral motion of the stem 24, and thus the tab 22, as shown in FIG. 4. A dog 28 on the inner surface of tab 22 projects inwardly towards the inner surface of wall 13 and is adapted to engage end 11 of dog 8 when the knife is properly and fully seated in the scabbard. In this arrangement, the inwardly extending dog 28 engages the end 11 and projects into recess 7. This interfering fit prevents movement of the knife from the scabbard unless the tab 22 is moved laterally. The dog 28 is bevelled and sloped near its top, as shown in FIG. 3, such that when the knife is inserted in the sheath, the dog 28 slides smoothly over the stop 11 and snaps into place once the top edge of the stop 11 clears the bottom edge of the dog 28.

To remove the knife 1 from the scabbard when properly inserted as shown in FIG. 1, the tab 22 is moved to the left or right as illustrated in FIG. 1 until the dog 28 clears surface 11 and become aligned with either channel 9 or channel 10. In this position, the knife may be moved outwardly permitting the dog 28 to move downwardly through the channels 9 or 10 until the dog clears the knife handle.

On insertion of the knife into the scabbard, the flexibility of the stem 24 permits dog 28 to ride up over the stop 8 until the dog 28 locks against end 11.

FIGS. 5, 6, 7 and 8 show a second embodiment of the knife/sheath combination of the present invention. In this embodiment, the sheath comprises a window 50 that extends along the majority of the blade holding portion of the sheath. This window 50 permits rapid draining of water from the sheath. The stem 52 is relatively shorter than stem 24 of the embodiment shown in FIGS. 1–3 and is disposed above the window. Preferably, the stem 52 is on the order of 2 to 3 inches in length. The length is somewhat of a function of the flexibility of the material of which it is made. It is integrally formed with and coupled to the sheath at tab 54 and has a dog 58 at its upper end 56.

The shorter length of the stem 52 causes the locking means to be less susceptible to accidental disengagement. Greater force is required to dislodge dog 58 from engagement with stop 11 on the knife because of the shorter lever arm of the stem. Accordingly, accidental striking of the stem 52 along its length of forces that are likely to be encountered in normal use are unlikely to dislodge the dog 58 from the stop 11. However, normally comfortable thumb pressure applied at the very end 56 of the stem is still sufficient to disengage the locking means. Since the stem is short, the lateral force necessary to disengage the locking means applied along the length of the stem is significantly greater than the lateral force necessary to disengage the locking means applied at its end 56. Accordingly, accidental disengagement of the knife from the sheath is less likely with the short stem 52. Further, the shorter stem provides substantially less stem surface area which can be accidentally struck.

The edges 60 of the channels 9 and 10 in this embodiment prevent lateral movement of the dog 58 beyond the edges 60. Further, the sheath is equipped with bosses 62 adjacent the bottom portion of the stem which also limit the lateral motion of the stem 52. Both the bosses 62 and the edges 60 limit the lateral motion of the stem so as to significantly reduce the possibility of breakage of the stem. Instead of utilizing bosses, the stem may be positioned within a channel in the sheath such that the edges of the channel restrict its lateral movement, thus eliminating the need for protruding bosses.

The handle 2 is ridged along surfaces 57 and smooth along opposing surfaces 61.

The knife comprises two locking assemblies, i.e., the dog 11 with its surrounding channels 9 and 10 and edges 60; one on each side of the knife. These locking assemblies are similar to one another and are axially located on either side of the knife. In this manner, the knife can be inserted in the sheath with either face facing outwards. The handle 2, and particularly the hilt 64, of the knife are asymmetrical and are shaped so as to conform to the hand of the user. The asymmetry of the handle in combination with a double edged blade having different cutting surfaces on either side permits identification of each cutting surface by the user without looking at the blade. Thus, for example, in FIG. 7 the coarser cutting edge of the blade is aligned with the backside of the handle.

While there has been shown and described what is at present considered the preferred embodiments of the present invention, it will be obvious to those skilled in the art that various changes and modifications may be made therein without departing from the scope of the invention as defined by the appended claims.

What is claimed is:

1. A tool and sheath combination having releasably interlocking means comprising:

said tool having a handle and a working element extending longitudinally from the end of the handle;

said sheath having inner and outer facing walls defining a pocket to receive said element on any one of a plurality of orientations;

a pair of engaging means formed on opposite sides of said handle adjacent to said working element, and a recess defining channels on either side of said engaging means;

outwardly extending lock means on said outer wall positioned to engage said engaging means on insertion of said working element into said pocket whereby said tool is locked into said sheath, said sheath further comprising rail means positioned on said inner wall such that when said tool is inserted in said sheath, said recesses on said handle facing the inner wall of said sheath engage said rail means; and means for supporting and moving said lock means under finger pressure from a normal lock position in a plane parallel to said facing walls to positions out of engagement with said engaging means whereby said tool may be removed from said sheath.

2. A tool and sheath combination as set forth in claim 1 wherein said means for moving said lock means is integrally formed with said outer wall of a resilient material having sufficient memory to return to a normal lock position after release of a deflecting force in a direction parallel to said facing walls.

3. A tool and sheath combination as set forth in claim 2 wherein said lock means and said engaging means have respectively complementary inner and outer facing surfaces with a dog on one adopted to co-act with a stop on the other in said normal lock position.

4. A tool and sheath combination as set forth in claim 3 wherein said dog is formed on the inner surface of said lock means and said stop is formed on opposite sides of said handle.

5. A tool and sheath combination as set forth in claim 4 wherein said tool is a knife.

6. A tool and sheath combination having releasably interlocking means comprising:

a recess on one of said tool and a wall of said sheath, having a stop extending outwardly from said recess, with portions of said recess defining channels on either side of said stop, a dog on the other one of said tool and said wall of said sheath positioned so that when said tool is inserted in said sheath, said dog is positioned within said recess and engages said stop so as to lockingly engage said tool in said sheath, means for moving said stop or said dog on said sheath parallel said wall of said sheath to a position in which said dog does not engage said stop, whereby said tool may be removed from said sheath, and means for limiting lateral motion of said stem comprising bosses disposed adjacent the lower portion of said stem.

7. A tool and sheath combination having releasably interlocking means comprising:

a recess on one of said tool and a wall of said sheath having a stop extending outwardly from said recess, with portions of said recess defining channels on either side of said stop, a dog on the other one of said tool and said wall of said sheath positioned so that when said tool is inserted in said sheath, said dog is positioned within said recess and engages said stop so as to lockingly engage said tool in said sheath, means for moving said stop or said dog on said sheath parallel said wall of said sheath to a position in which said dog does not engage said stop, whereby said tool may be removed from said sheath, and wherein one of said dog and said stop is partially bevelled at an edge such that, as said tool is inserted in said sheath, said dog slides smoothly over said stop and lockingly engages said stop when said dog passes said stop.

8. A knife and sheath combination having releasably interlocking means comprising:

a knife comprising a blade having diametrically opposed faces, first and second recesses, each having a stop extending outwardly from said recess, with portions of said recesses defining channels on either side of said stops, said first and second recesses disposed contiguous said diametrically opposed faces of said blade, respectively, a dog on a wall of said sheath positioned so that when said knife is inserted in said sheath, said dog is positioned within one of said recesses and engages said stop of one of said recesses so as to lockingly engage said knife in said sheath, and means for moving said dog on said sheath parallel said wall of said sheath to a position in which said dog does not engage said stop, whereby said knife may be removed from said sheath.

9. A tool and sheath combination as set forth in claim 8 wherein said sheath comprises inner and outer facing walls defining a pocket for receiving said knife and said dog is positioned on said outer wall, said sheath further comprising a pair of rails positioned on said inner wall directly opposite said dog such that when the stop of one of said recesses engages said dog, the channels of the other of said recesses engages said pair of rails.

10. A knife and sheath combination having releasably interlocking means comprising:

a knife comprising a blade having diametrically opposed faces, first and second dogs, said dogs disposed contiguous said diametrically opposed faces of said blade, a recess on a wall of said sheath having a stop extending outwardly from said recess with portions of said recess defining channels on either side of said stop, said stop positioned so that when said knife is inserted in said sheath, said stop engages one of said dogs so as to lockingly engage said knife in said sheath, and means for moving said stop and recess on said sheath parallel said wall of said sheath to a position in which said stop does not engage said dogs, whereby said knife may be removed from said sheath.

11. A tool and sheath combination having releasably interlocking means comprising:

a knife comprising first and second dogs extending outwardly from opposite sides of said knife, a sheath having inner and outer facing walls adapted to accept a portion of said knife in two possible orientations, a stem having a first end coupled to said outer wall of said sheath and extending upwardly therefrom on the order of two inches, a third dog disposed on the second end of said stem positioned such that when said knife is inserted in said sheath, said third dog contacts said first or second dog so as to lockingly engage said tool in said sheath, and said stem being resilient in a direction lateral to said facing walls of said sheath such that said second dog can be moved laterally out of engagement with said first dog under finger pressure applied at said second end of said stem, whereby said tool may be removed from said sheath.

12. A tool and sheath combination as set forth in claim 11 wherein one of said first and second dogs is partially beveled such that when said knife is inserted in said sheath, said second dog will slide smoothly over said first dog and lockingly engage said first dog when said first dog passes said second dog.

13. A knife and sheath combination having releasably interlocking means comprising:

a knife having diametrically opposed blade faces, a sheath having inner and outer facing walls defining a pocket to receive said knife in two possible orientations, engaging means formed on said knife comprising first and second stops, one each disposed contiguous said diametrically opposed faces of said knife, lock means formed on the outer facing wall of said sheath positioned to engage said engaging means when said tool is inserted in said sheath, said lock means comprising a third stop for engaging said first stop of second stop, and resilient means for biasing said lock means towards said engaging means with said first or second stop normally inter-engaging with said third stop having sufficient resilience such that said third stop can be moved out of engagement with said engaging means in the presence of finger pressure in a direction parallel said facing walls.

* * * * *